US006753831B1

(12) United States Patent
Ide et al.

(10) Patent No.: US 6,753,831 B1
(45) Date of Patent: Jun. 22, 2004

(54) DISPLAY DEVICE

(75) Inventors: Shigeo Ide, Yamanashi (JP); Yasunori Higuchi, Yamanashi (JP); Naruhiro Sato, Fukuroi (JP); Kenichiro Hosoi, Fukuroi (JP)

(73) Assignee: Pioneer Corporation, Tokyo (JP)

( * ) Notice: Subject to any disclaimer, the term of this patent is extended or adjusted under 35 U.S.C. 154(b) by 358 days.

(21) Appl. No.: 09/606,671

(22) Filed: Jun. 30, 2000

(30) Foreign Application Priority Data

Jul. 2, 1999 (JP) ..... 11-189677

(51) Int. Cl.[7] ..... G09G 3/28

(52) U.S. Cl. ..... 345/60; 345/213; 345/68; 345/99; 345/100; 345/87; 345/211; 345/212

(58) Field of Search ..... 345/60, 87, 211, 345/212, 213, 150–154, 99, 100, 132; 348/554, 571, 686, 687, 68

(56) References Cited

U.S. PATENT DOCUMENTS 6,476,801 B2 * 11/2002 Nagai ..... 345/213
6,495,968 B2 * 12/2002 Tokunaga ..... 315/169.4
6,518,943 B1 * 2/2003 Masumura ..... 345/67

* cited by examiner

*Primary Examiner*—Richard Hjerpe
*Assistant Examiner*—Ali Zamani
(74) *Attorney, Agent, or Firm*—Sughrue Mion, PLLC

(57) ABSTRACT

A display device is designed to ensure that image processing parameters are transferred in response to switching between input video signals. The display panel is forceably stopped from being driven for a predetermined period when a video signal of an input target is switched over to another video signal.

15 Claims, 6 Drawing Sheets

DISPLAY DEVICE

BACKGROUND OF THE INVENTION

1. Field of the Invention

The present invention relates to a display device that can display images in accordance with various television signals or other image signals such as video signals produced in a computer.

2. Description of Related Art

Recently, liquid-crystal display devices, plasma display devices, or electroluminescence display devices have been introduced into the market as thin-shape flat display devices. On the other hand, video signals from personal computers are available nowadays as video signals to be processed in a display device in addition to television signals such as NTSC and HiVision HDTV format signals.

Accordingly, it is desired to provide flat display devices that can display images based on the video signal generated in any of the above-mentioned schemes.

However, it is known that each of such video signals has a property that is unique to each of the schemes mentioned above. Therefore, a problem arises that, when the input video signal is switched over from one scheme to one supplied by another scheme, the state of the display of images will be changed as well.

For this reason, in cases where video signals of different types are alternatively displayed in response to a switching operation, a stage of the image signal processing is performed in such a way that parameters suitable for the property of each of the video signals are employed to perform the image signal processing.

For such a process, each of the image processing parameters corresponding to each scheme has been stored in a memory in advance. Then, the parameters corresponding to input video signals are read from the stored parameters and then transferred to a parameter memory of an image signal processing circuit.

There, however, is a problem that when a plasma display panel or an electroluminescence display panel is used as a display panel, the aforementioned parameter transfer would fail due to radiation noise generated by the display panel itself.

The present invention has been developed to solve the aforementioned problems.

An object of the present invention is to provide a display device which surely performs a transfer operation of image processing parameters in response to the switching of input video signals.

A display device according to the present invention is to display an image on a display panel having a plurality of electrode rows and a plurality of electrode columns arranged in transverse relation to said electrode rows, by applying various drive pulses to each of said electrode rows and said electrode columns. The display device comprises a selector for selecting one of a plurality of input video signals in response to an input video selecting signal to capture a selected input video signal as a selected video signal; image processing parameter memories for storing image processing parameters corresponding to each of said input video signals; parameter selecting means for selecting alternatively one of said image processing parameters stored in said image processing parameter memories in response to said input video selecting signal; a parameter register for storing, by overwriting, said image processing parameters selected by said parameter selecting means in response to a switching between said input video selecting signals; image signal processing means for obtaining drive data by performing an image signal processing on said selected video signal in accordance with said image processing parameters stored in said parameter register; display panel drive means for generating each of said drive pulses which should be applied to each of said electrode rows and said electrode columns in accordance with said drive data; and a means for stopping said display panel drive means from generating said drive pulses for a predetermined period in response to the switching between said input video selecting signals.

DETAILED DESCRIPTION OF THE PREFERRED EMBODIMENTS

Figure 1:
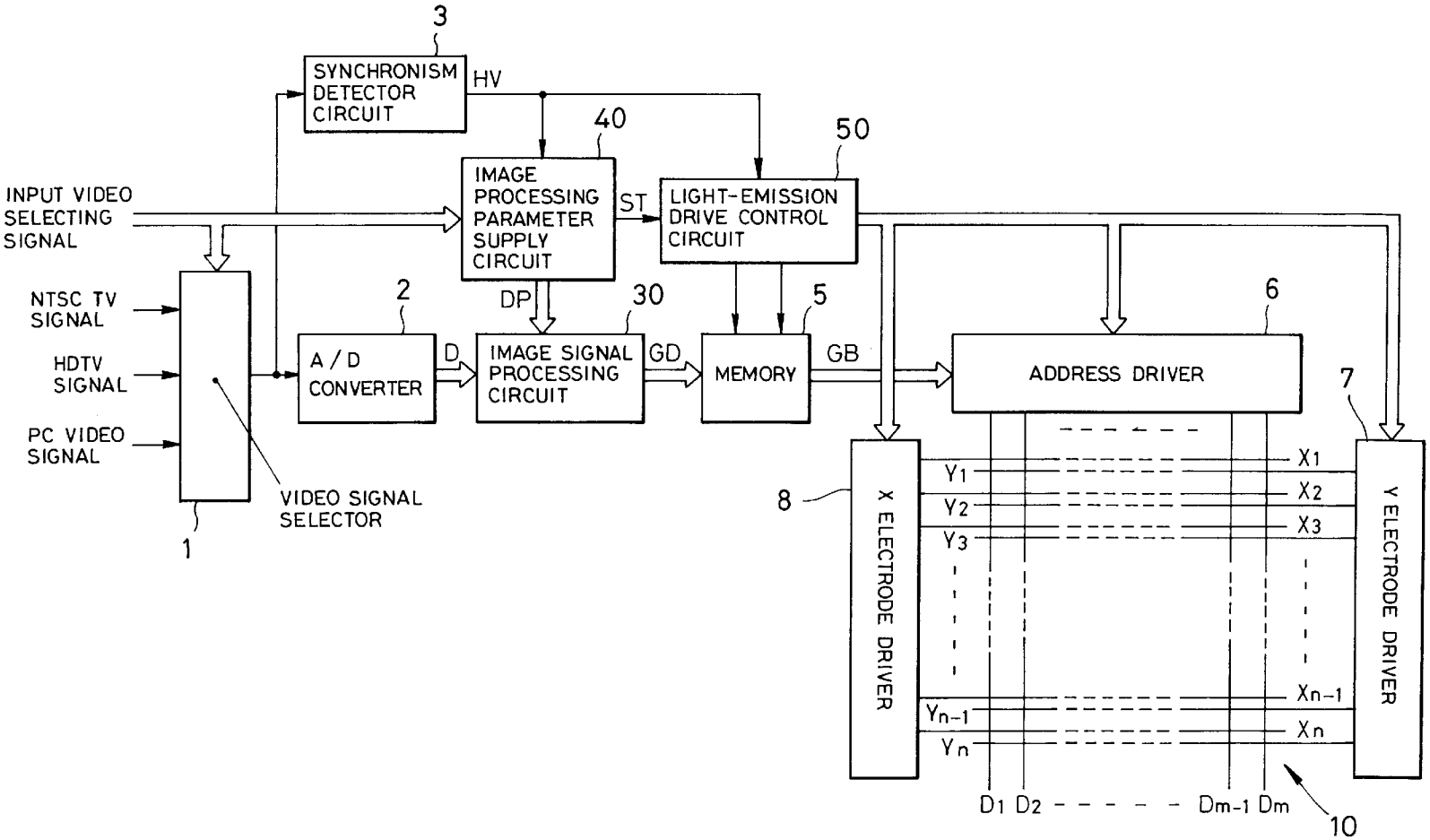
FIG. 1 is a diagram schematically showing the configuration of a display device that employs a plasma display panel as a flat display panel.

FIG. 1 is a diagram showing the configuration of a display device according to the present invention.

The display device shown in FIG. 1 is provided with a plasma display panel 10 (hereinafter referred to as the PDP 10) as a display device. The PDP 10 comprises m electrode columns $D_1$–$D_m$ as address electrodes and n electrode rows $X_1$–$X_n$ and n electrode rows $Y_1$–$Y_n$, arranged in transverse relation to the electrode columns. A pair of an electrode row X and an electrode row Y forms an electrode row corresponding to one row of the PDP 10. The electrode columns D, and the electrode rows X and Y are covered with a dielectric layer in a discharge space. A discharge cell C is formed corresponding to one pixel at a crossover of each electrode row pair and an electrode column.

A video signal selector 1 selects a video signal from the video signals of three systems consisting of schemes different from each other in accordance with an input video selecting signal and supplies the video signal to an A/D converter 2 and a synchronism detector circuit 3. Here, the video signals are inputted to allow the PDP 10 to display an image, the video signals being a NTSC television signal, a HDTV signal, and a personal computer video signal (hereinafter referred to as a PC video signal).

The A/D converter 2 samples the video signal supplied from the video signal selector 1 and converts the video signal, for example, into 6-bit pixel data D corresponding to each pixel, and then supplies the pixel data D to an image signal processing circuit 30.

The synchronism detector circuit 3 detects a horizontal synchronous signal and a vertical synchronous signal from the video signal supplied from the aforementioned video signal selector 1. Then, the synchronism detector circuit 3 supplies a synchronism detection signal HV that shows the detection timing of the respective synchronous signals to an image processing parameter supply circuit 40 and light-emission drive control circuit 50.

Figure 2:
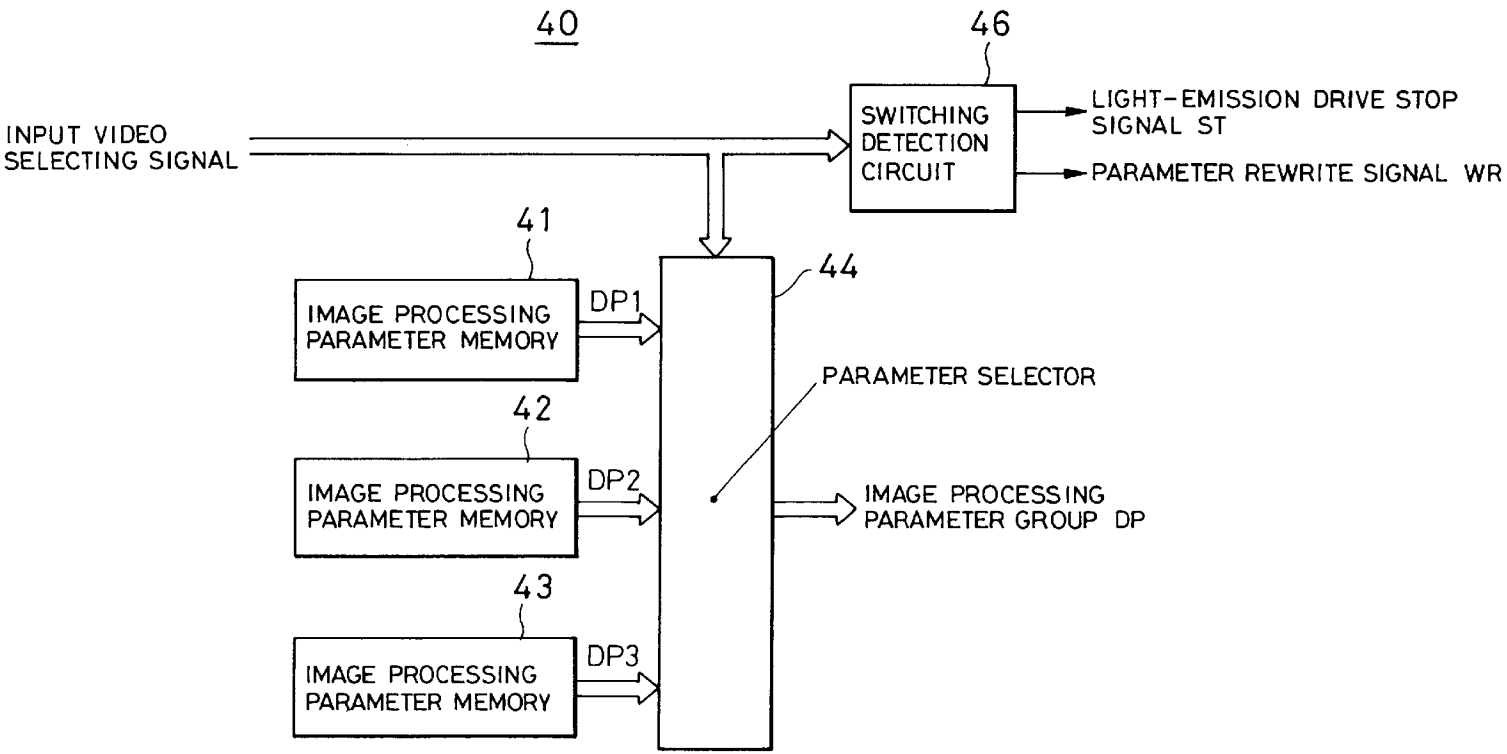
FIG. 2 is a diagram showing the internal configuration of an image processing parameter supply circuit 40.

FIG. 2 is a diagram showing the internal configuration of the image processing parameter supply circuit 40.

Referring to FIG. 2, various image processing parameters that are used for displaying an image in accordance with the NTSC television signal are stored in advance in an image processing parameter memory 41. The image processing parameter memory 41 supplies the various image processing parameters that are stored therein to a parameter selector 44 as a first image processing parameter group DP1. Various image processing parameters that are used for displaying an image in accordance with the HDTV signal are stored in advance in an image processing parameter memory 42. The image processing parameter memory 42 supplies the various image processing parameters that are stored therein to a parameter selector 44 as a second image processing parameter group DP2. Various image processing parameters that are used for displaying an image in accordance with the PC video signal are stored in advance in an image processing parameter memory 43. The image processing parameter memory 43 supplies the various image processing parameters that are stored therein to a parameter selector 44 as a third image processing parameter group DP3.

The various image processing parameters that are stored in each of the image processing parameter memories 41–43 correspond to display quality adjustment processing in the image signal processing circuit 30, scan line conversion processing, automatic brightness adjustment processing, gamma property correction processing, and multi-gray-scale processing.

The parameter selector 44 selects, in accordance with an input video selecting signal, one of the first image processing parameter group DP1, the second image processing parameter group DP2, and the third image processing parameter group DP3, which are supplied from each of the image processing parameter memories 41–43. Then, the parameter selector 44 supplies the selected one to the image signal processing circuit 30 as selected image processing parameter group DP.

Figure 3:
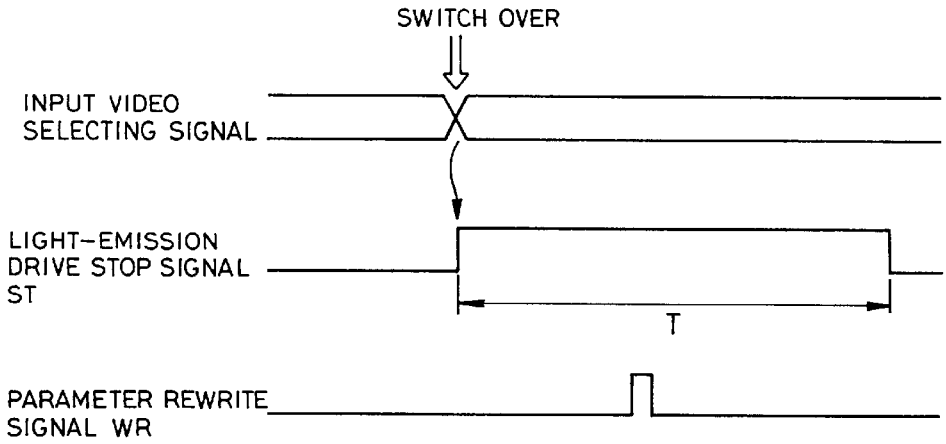
FIG. 3 is an explanatory diagram showing the operation of the switching detection circuit 46.

As shown in FIG. 3, the switching detection circuit 46 generates a light-emission drive stop signal ST, which provides a logic level of "1" for a predetermined period T, and then supplies the signal to the light-emission drive control circuit 50 when the input video selecting signal is switched over to a value for selecting another video signal. In addition, the switching detection circuit 46 generates a parameter rewrite signal WR of a logic level of "1" at the timing shown in FIG. 3 after the aforementioned input video selecting signal has been switched over and then supplies the parameter rewrite signal WR to the image signal processing circuit 30.

The aforementioned predetermined period T corresponds to the processing time required for a new image processing parameter group to be overwritten to a parameter register 31 (to be described later) of the image signal processing circuit 30 after the input video selecting signal has been switched over.

With the configuration described above, the image processing parameter supply circuit 40 supplies, to the image signal processing circuit 30, the image processing parameter group DP corresponding to the video signal shown by the input video selecting signal among the NTSC television signal, the HDTV signal, and the PC video signal. Furthermore, when the input video signal has been switched over, the image processing parameter supply circuit 40 continues to supply the light-emission drive stop signal ST with a logic level of "1" to the light-emission drive control circuit 50 until the aforementioned image processing parameter group DP is overwritten to the parameter register 31 (to be described later) of the image signal processing circuit 30.

Figure 4:
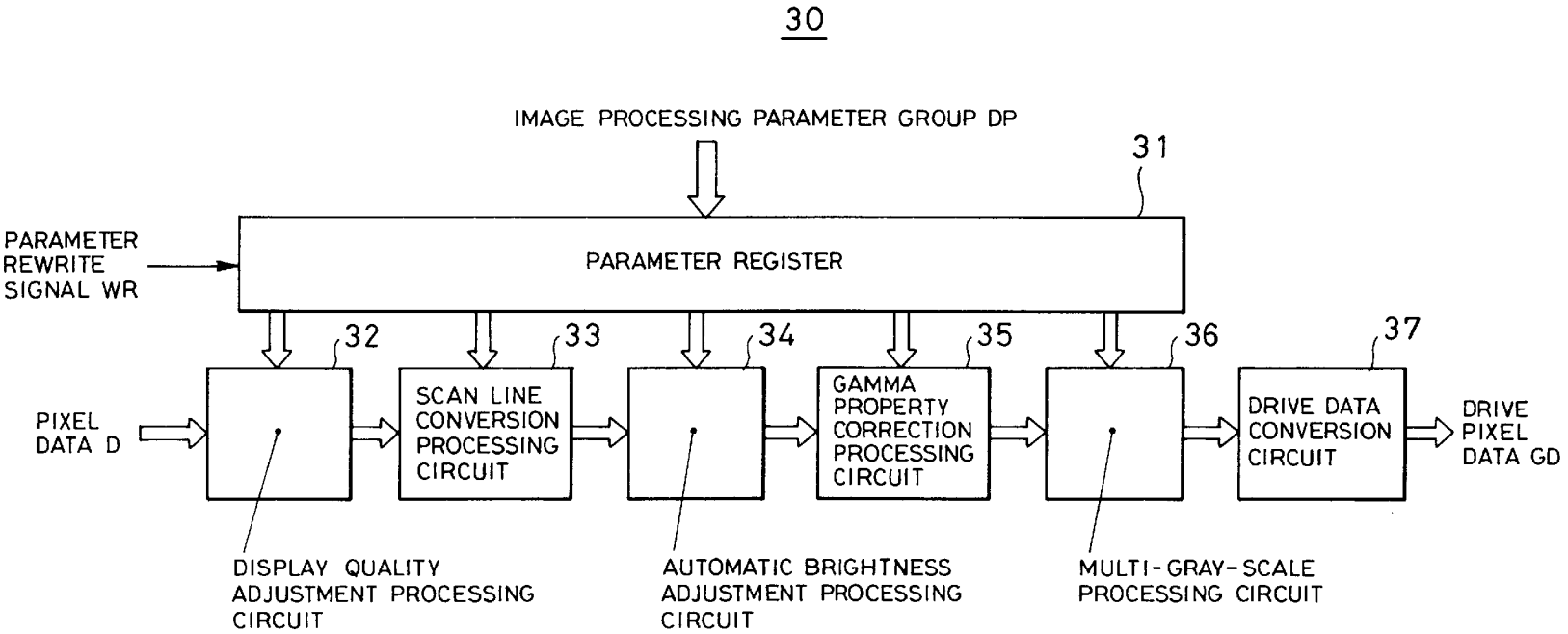
FIG. 4 is a diagram showing the internal configuration of an image signal processing circuit 30.

FIG. 4 is a view showing the internal configuration of the image signal processing circuit 30.

Referring to FIG. 4, in accordance with the aforementioned parameter rewrite signal WR, the parameter register 31 stores, by overwriting, the image processing parameter group DP that has been supplied by the aforementioned image processing parameter supply circuit 40. Moreover, the parameter register 31 supplies each of the parameters of the stored image processing parameter group DP to each of the corresponding processing circuits, that is, a display quality adjustment processing circuit 32, a scan line conversion processing circuit 33, an automatic brightness adjustment processing circuit 34, a gamma property correction processing circuit 35, and a multi-gray-scale processing circuit 36. The display quality adjustment processing circuit 32 performs display quality adjustment processing on the aforementioned pixel data D in accordance with the display quality adjustment algorithm based on the parameters supplied from the parameter register 31. The scan line conversion processing circuit 33 performs line-sequential scan conversion based on the parameters supplied from the parameter register 31 on the pixel data D supplied in a manner of interlaced scan. The automatic brightness adjustment processing circuit 34 adjusts the brightness level of the pixel data D with the conversion property based on the parameters supplied from the parameter register 31. The gamma property correction processing circuit 35 performs correction processing to release the gamma property of the pixel data D having the gamma property with the correction property based on the parameters supplied from the parameter register 31. The multi-gray-scale processing circuit 36 performs error diffusion processing and dither processing on the pixel data D, based on the parameters supplied from the parameter register 31. A drive data conversion circuit 37 converts, into drive pixel data GD which is driven the PDP 10 for output, the pixel data that has been subjected to image signal processing by each of the aforementioned display quality adjustment processing circuit 32, the scan line conversion processing circuit 33, the automatic brightness adjustment processing circuit 34, the gamma property correction processing circuit 35, and the multi-gray-scale processing circuit 36.

A memory 5 writes in sequence the drive pixel data GD obtained by being subjected to various image signal processing by the image signal processing circuit 30, in accordance with the write signal supplied from the light-emission drive control circuit 50. Here, when writing to one screen (with n rows and m columns) has been completed, the memory 5 divides the aforementioned drive pixel data GD into each of bit digits in accordance with the read signal supplied from the light-emission drive control circuit 50. Then, the memory 5 groups the same bit digits into each one line (m bits) to form drive data bits $GB_1$–$GB_m$, which are in turn supplied to an address driver 6.

Figure 5:
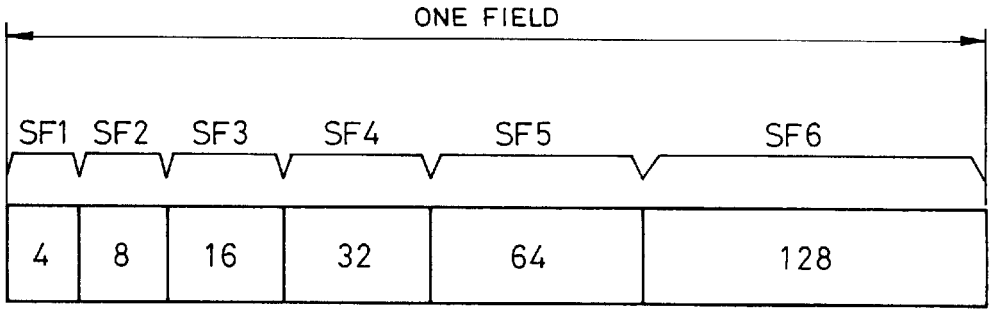
FIG. 5 is a diagram showing an example of a light-emission drive format.

The light-emission drive control circuit 50 supplies various timing signals to the address driver 6, a Y electrode driver 7, and an X electrode driver 8 to perform the light-emission drive control of the PDP 10 in accordance with the light-emission drive format that employs, for example, the sub-field method as shown in FIG. 5. Furthermore, FIG. 5 shows an example in which the display period of one field is divided into six sub-fields consisting of sub-fields SF1 to SF6.

Figure 6:
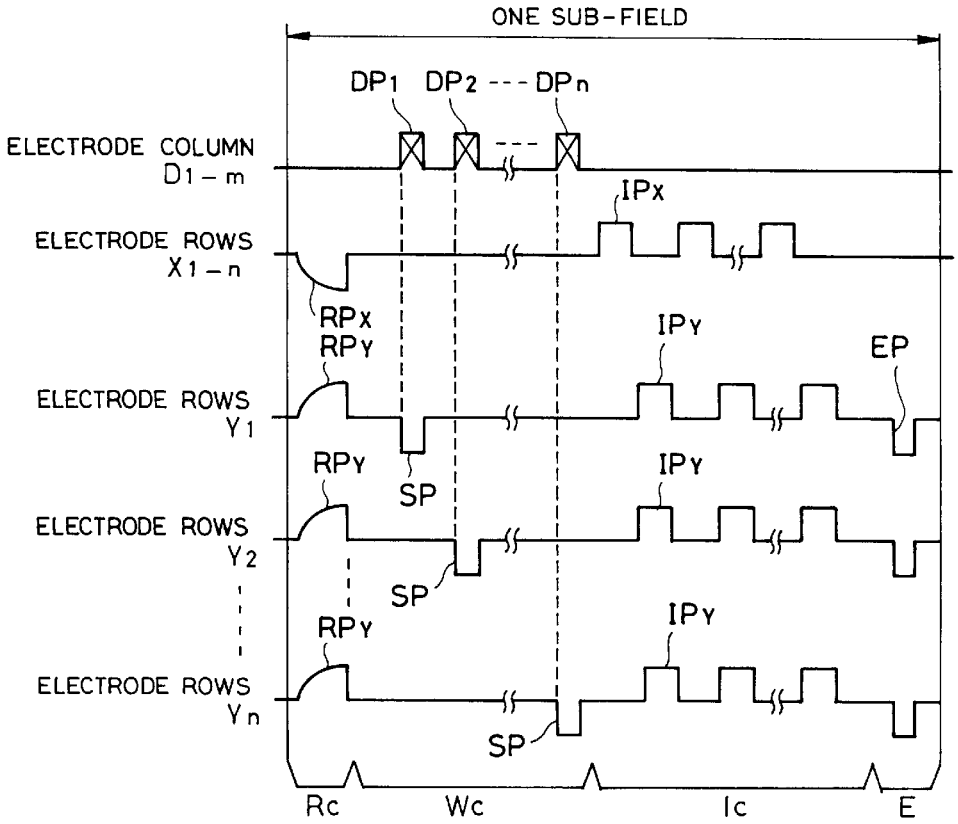
FIG. 6 is a diagram showing the timing of the application of various drive pulses that are applied to a PDP 10 within one sub-field.

FIG. 6 shows the application timing of various drive pulses that each of the aforementioned address driver 6, the Y electrode driver 7, and the X electrode driver 8 applies to each of the electrode columns D and the electrode rows X and Y of PDP 10 within one sub-field in accordance with various timing signals supplied from the aforementioned light-emission drive control circuit 50.

First, in a reset process Rc, the Y electrode driver 7 applies a reset pulse $RP_X$ of positive polarity to the electrode rows $X_1$–$X_n$. At the same time, the X electrode driver 8 applies a reset pulse $RP_Y$, of negative polarity to the electrode rows $Y_1$–$Y_n$. The simultaneous application of the reset pulses $RP_X$ and $RP_Y$ causes all the discharge cells in the PDP 10 to undergo reset discharge and thus a uniform wall electronic charge to be formed in each of the discharge cells. This causes all the discharge cells in the PDP 10 to be reset once to "light-emitting cells".

Next, in an address process Wc, the address driver 6 converts each of the drive data bits $GB_1$–$GB_m$ supplied from the aforementioned memory 5 into m pixel data pulses having a voltage corresponding to each logic level. At this time, when the drive data bit GB has, for example, a logic level of "1" the address driver 6 generates a high voltage pixel data pulse. When the drive data bit GB has, for example, a logic level of "0", the address driver 6 generates a low voltage pixel data pulse (0V). The address driver 6 prepares these m pixel data pulses, that is, the pixel data pulses of one line as the pixel data pulse group DP. First, the address driver 6 applies the pixel data pulse group $DP_1$ corresponding to the first line to the electrode columns $D_1$–$D_m$ and then applies the pixel data pulse group $DP_2$ corresponding to the second line to the electrode columns $D_1$–$D_m$. Likewise, the address driver 6 applies sequentially the pixel data pulse groups $DP_3$–$DP_n$ corresponding to the third to nth line to the electrode columns $D_1$–$D_m$. Here, the X electrode driver 8 generates a scan pulse SP of a negative polarity at the same timing as the application timing of each of the aforementioned pixel data pulse groups DP and then applies the scan pulse SP to the electrode rows $Y_1$–$Y_n$ in sequence as shown in FIG. 6. In this driving process, discharge (selective erase discharge) is generated only in the discharge cells located at the crossovers of the "rows" to which the scan pulse SP has been applied and the "columns" to which a high-voltage pixel data pulse has been applied. Thus, the wall electronic charges remaining in the discharge cells are selectively erased. By such selective erase discharge, the discharge cells that have been reset to the "light-emitting cells" in the aforementioned reset process Rc are changed to the "non-light-emitting cells". Furthermore, no discharge is generated in each of the discharge cells that belong to the "columns" to which a low-voltage pixel data pulse has been applied and the state of being reset in the aforementioned reset process Rc, that is, the "light-emitting cell" state is sustained therein.

Next, in a simultaneous sustaining discharge process Ic, the Y electrode driver 7 and X electrode driver 8 apply alternately sustaining pulses $IP_X$ and $IP_Y$ of positive polarity to the electrode rows $X_1$–$X_n$ and $Y_1$–$Y_n$. Furthermore, the number of times (period) of application of the sustaining pulses $IP_X$ and $IP_Y$ in the simultaneous sustaining discharge process Ic is predetermined for each sub-field SF.

For example, as shown in FIG. 5, if the number of times of applications in sub-field SF1 is equal to "4", then

SF1: 4

SF2: 8

SF3: 16

SF4: 32

SF5: 64

SF6: 128

The discharge cells in which the wall electronic charges remain in the aforementioned address process Wc, that is, the "light-emitting cells" carry out sustaining discharge to emit light by the application of the sustaining pulse IP, each time the sustaining pulses $IP_X$ and $IP_Y$ are applied. Thus, the light-emission state is sustained corresponding to the number of times (period) assigned to each sub-field.

Finally, in an erase process E, the Y electrode driver 7 applies the erase pulse EP of negative polarity as shown in FIG. 6 to the electrode rows $Y_1$–$Y_n$, thereby allowing all the discharge cells to undergo the erase discharge simultaneously to erase the wall electronic charges remaining in each of the discharge cells.

By performing the operation within one sub-field as described above in sub-fields SF1–SF6 as shown in FIG. 5, 64 levels of halftone are displayed with the following light-emission brightness ratio.

{0, 4, 8, 12, 16, 20, . . . , 248, 252}

However, the light-emission drive control circuit 50 stops supplying the aforementioned timing signal to the aforementioned address driver 6, the Y electrode driver 7, and the X electrode driver 8 while the aforementioned image processing parameter supply circuit 40 is supplying the light-emission drive stop signal ST of logic level of "1" as shown in FIG. 3. That is, the application operation of various drive pulses as shown in FIG. 6 is forceably stopped.

This causes the PDP 10 to stop being driven until the image processing parameter groups DP stored in the image processing parameter memories 41–43 are transferred to the parameter register 31 that is provided in the image signal processing circuit 30. Thus, parameters can be rewritten without being affected by radiation noise from the PDP 10.

Furthermore, in the aforementioned embodiment, the image signal processing thereof includes the display quality adjustment processing, the scan line conversion processing, the automatic brightness control processing, the gamma property correction processing, and multi-gray-scale processing. However, the embodiment may be so adapted as to execute at least any one of them.

As described above, according to the present invention, the display panel is adapted to forceably stop being driven for a predetermined period when a video signal of an input target is switched over to another video signal. This can prevent radiation noise from being generated in the display panel until image processing parameters corresponding to the video signal of new input targets are written to a parameter register provided in the image signal processing circuit.

As described in the foregoing, the display device according to the present invention is devised that image processing parameters are surely transferred in response to the switching between input video signals.

What is claimed is:

1. A display device for displaying an image on a display panel having a plurality of electrode rows and a plurality of electrode columns arranged in transverse relation to said electrode rows, by applying various drive pulses to each of said electrode rows and said electrode columns, said display device comprising:

a selector for selecting one of a plurality of input video signals in response to an input video selecting signal to capture a selected input video signal as a selected video signal, image processing parameter memories for storing image processing parameters corresponding to each of said input video signals, parameter selecting means for alternatively selecting one of said image processing parameters stored in said image processing parameter memories in response to said input video selecting signal, a parameter register for storing, by overwriting, said image processing parameters selected by said parameter selecting means in response to a switching between said input video selecting signals, image signal processing means for obtaining drive data by performing an image signal processing on said selected video signal in accordance with said image processing parameters stored in said parameter register, display panel drive means for generating each of said drive pulses to be applied to each of said electrode rows and said electrode columns in accordance with said drive data, and means for stopping said display panel drive means from generating said drive pulses for a predetermined period in response to the switching between said input video selecting signals.

2. A display device according to claim 1, wherein said image signal processing includes at least one of a display quality adjustment processing, a scan line conversion processing, an automatic brightness control processing, a gamma property correction processing, and a multi-gray-scale processing.

3. The display device according to claim 1, wherein said predetermined period includes at least a processing time from the switching of said input video selecting signals until said image processing parameters are stored in said parameter output memory.

4. A display device according to claim 1, wherein said display device is a plasma display panel.

5. A display device according to claim 1, wherein said video signals are NTSC, HDTV and PC video signals.

6. A display device according to claim 1, wherein said video signals are HDTV and PC video signals.

7. A display device according to claim 1, wherein said means for stopping stops said display panel drive means until the image processing parameters stored in the image processing parameter memories are transferred to the parameter register.

8. A display device comprising:

a display panel having electrode rows and electrode columns; and a control circuit that selects a first input video signal in response to a selecting signal, that selects parameters in response to said selecting signal, that processes the selected first input video signal to obtain drive data, that generates drive pulses to be applied to said electrode rows and said electrode columns in accordance with said drive data, and that stops applying said drive pulses for a predetermined period in response to a switching signal that switches said selected first input video signal to a second input video signal, wherein said second input video signal is a different type then said first input video signal.

9. A display device as claimed in claim 8, wherein the control circuit comprises:

at least one image processing memory that stores first parameters corresponding to said first input video signal and that stores second parameters corresponding to said second input video signal, wherein said control circuit selects the first or second parameters as selected paramters in response to said selecting signal.

10. A display device as claimed in claim 9, wherein said control circuit comprises:

a parameter register for storing, by overwriting, said selected parameters in response to the switching between said first and second input video signals.

11. A display device as claimed in claim 9, wherein said control circuit comprises:

an image signal processor that obtains drive data by processing said selected first video signal in accordance with said first parameters selected by said selecting signal.

12. A display device as claimed in claim 8, wherein said control circuit comprises:

a display panel driver that generates said drive pulses to be applied to said electrode rows and said electrode columns.

13. A display device comprising:

a display panel having electrode rows and electrode columns;

a control circuit that selects an input video signal in response to a selecting signal, that applies drive pulses to the electrode rows and the electrode columns to display an image on the display panel, and that stops applying the drive pulses for a predetermined period in response to a switching signal that switches said input video signals to another type of input video signal.

14. A display device as claimed in claim 8, wherein said control circuit comprises:

an image signal processor that obtains drive data by processing said selected first video signal in accordance with said first parameters selected by said selecting signal.

15. A display device according to claim 14, wherein said control circuit comprises:

a display panel driver that generates said drive pulses to be applied to said electrode rows and said electrode columns.

* * * * *

UNITED STATES PATENT AND TRADEMARK OFFICE

CERTIFICATE OF CORRECTION

PATENT NO. : 6,753,831 B1
DATED : June 22, 2004
INVENTOR(S) : Ide et al.

It is certified that error appears in the above-identified patent and that said Letters Patent is hereby corrected as shown below:

Title page,
Item [*] Notice: delete the phrase "by 358" and insert -- by 433 days --

Signed and Sealed this

Seventh Day of June, 2005

JON W. DUDAS
*Director of the United States Patent and Trademark Office*

UNITED STATES PATENT AND TRADEMARK OFFICE

CERTIFICATE OF CORRECTION

PATENT NO. : 6,753,831 B1
DATED : June 22, 2004
INVENTOR(S) : Shigeo Ide et al.

It is certified that error appears in the above-identified patent and that said Letters Patent is hereby corrected as shown below:

Title page,
Item [56], References Cited, U.S. PATENT DOCUMENTS, add:
-- 6,091,396 A * 7/2000 Minami --.

Signed and Sealed this

Twenty-third Day of May, 2006

JON W. DUDAS
*Director of the United States Patent and Trademark Office*